US006877260B1

(12) United States Patent
Stützer

(10) Patent No.: US 6,877,260 B1
(45) Date of Patent: Apr. 12, 2005

(54) IRON SKIRT

(75) Inventor: Franz Alban Stützer, Offenbach (DE)

(73) Assignee: Rowenta-Werke GmbH (DE)

( * ) Notice: Subject to any disclaimer, the term of this patent is extended or adjusted under 35 U.S.C. 154(b) by 613 days.

(21) Appl. No.: 09/625,517

(22) Filed: Jul. 26, 2000

(30) Foreign Application Priority Data

Jul. 31, 1999 (DE) ..... 199 36 189

(51) Int. Cl.[7] ..... D06F 75/30
(52) U.S. Cl. ..... 38/88
(58) Field of Search ..... 38/88, 91, 93, 38/95, 80, 81, 77.83, 66, 17, 14, 15, 16, 97, 94; 72/711, 253.1, 709; 425/381.2; D32/68, 70, 71

(56) References Cited

U.S. PATENT DOCUMENTS

| | | | | | |
|---|---|---|---|---|---|
| 2,276,726 | A | | 3/1942 | Huffman | |
| 2,542,858 | A | * | 2/1951 | Boring | 38/77.83 |
| 3,661,480 | A | * | 5/1972 | Forschner et al. | 418/179 |
| 3,831,334 | A | * | 8/1974 | Rutkowski et al. | 52/288.1 |
| 4,524,263 | A | * | 6/1985 | Yamac | 126/411 |
| 4,634,019 | A | * | 1/1987 | Pherigo | 220/810 |
| 4,747,222 | A | | 5/1988 | Riba | |
| 4,815,224 | A | * | 3/1989 | Miller | 38/77.8 |
| 4,864,971 | A | | 9/1989 | von Stein | |
| 5,444,216 | A | | 8/1995 | Bouleau et al. | |
| 5,475,199 | A | * | 12/1995 | Buchanan | 219/243 |
| 5,601,179 | A | * | 2/1997 | Wente et al. | 198/335 |
| 5,623,775 | A | | 4/1997 | Farrington et al. | |
| 5,782,021 | A | | 7/1998 | Hall | |
| 6,170,705 | B1 | * | 1/2001 | Schneider et al. | 222/107 |
| 6,370,934 | B1 | * | 4/2002 | Maier | 72/467 |
| 6,557,388 | B1 | * | 5/2003 | Mitsumaru et al. | 72/253.1 |
| 2001/0023606 | A1 | * | 9/2001 | Seimer et al. | 72/253.1 |

FOREIGN PATENT DOCUMENTS

| | | | |
|---|---|---|---|
| DE | 35 13 508 A1 | | 10/1986 |
| DE | 37 13 625 C1 | | 3/1988 |
| EP | 1225266 | * | 12/2001 |
| FR | 2 566 439 | | 12/1985 |

OTHER PUBLICATIONS

Stobart, Pushing Plastic: The Extrusion of Profile Parts, 1987, Mechanical Engineering, vol. 109, No. 6, pp 46–50.*
Saprykin, Soviet Electrical Engineering: Advanced Technology and Special Production Equipment for Mechanization and Automation of Consumer–Goods Production: Present State and Prospects for Development and Introductions, 1985, vol. 56, No. 6, pp72–75.*
Zambetis–Jones, Material for the 90s: Plastics and Metals in Appliance Manufacture including Related Information, 1989, Appliance Manufacturer, vol. 37, No. 8, p20.*
Dzierwa, Designing with Plastics: A Calculated Effort, 1990, Appliance, vol. 47, iss 4, pp27–32.*

* cited by examiner

*Primary Examiner*—Ismael Izaguirre
(74) *Attorney, Agent, or Firm*—Ostrolenk, Faber, Gerb & Soffen, LLP

(57) ABSTRACT

An iron skirt formed by a blank cut off from a hollow profile.

11 Claims, 3 Drawing Sheets

Fig. 1
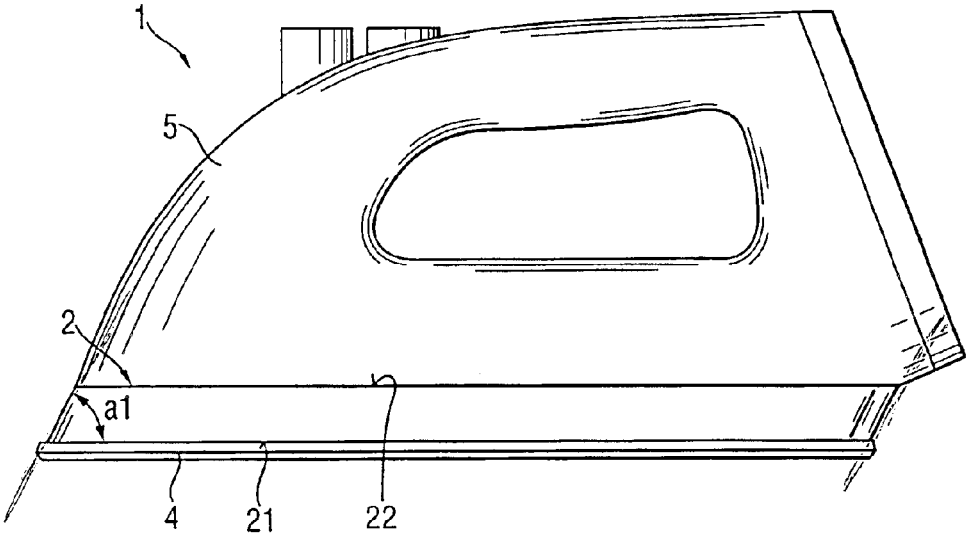
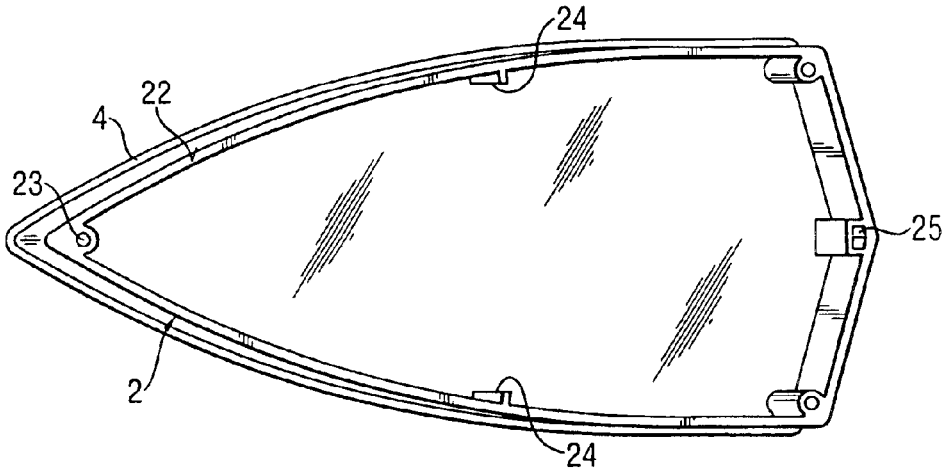
Fig. 2

IRON SKIRT

BACKGROUND OF THE INVENTION

1. Field of the Invention

The invention relates to skirts of irons.

2. Discussion of the Prior Art

The term iron skirt is intended to mean the outer visible part of the iron casing which is located directly above the hot iron soleplate. A heat shield is often installed in the iron skirt, which is usually produced from plastic, and, in the case of steam irons, is arranged between the soleplate and the water container. The iron skirt is part of the iron housing.

The iron skirt has to withstand the heat of the iron soleplate and has to have certain esthetic features which are important to the user. The iron skirt is usually produced from plastic by injection molding, it being necessary for the plastic and the coloring thereof to be heat-stable. Iron skirts made of metal are usually produced, starting from a metal blank, by deep-drawing and are then provided with an esthetically pleasing protective covering, e.g. made of chrome.

U.S. Pat. No. 5,613,310 discloses a specific production process for metal iron skirts which is distinguished by the edges of the metal blank being bent over. U.S. Pat. No. 5,782,021 discloses iron skirts which, for example, are also formed from plastic and then chrome-plated.

The known iron skirts are produced in processes which are distinguished by being discontinuous, the elements having to pass, one after the other, a number of tools for operations such as molding/casting or deep-drawing and completion. The provision of each new type of iron skirt thus involves high costs for expensive tools, which constitutes an obstacle to the further development of the shaping. In addition, the tools are essentially type-specific and do not make it possible for a family of similar products to be provided easily.

SUMMARY OF THE INVENTION

The object of the invention described hereinbelow is to provide an iron skirt which can be produced in a cost-effective, continuous or predominantly continuous process and makes it possible for a family of similar products to be achieved easily.

This object is achieved according to the invention by an iron skirt which is formed by a blank cut off from a profile.

The use of a profile makes it possible for the iron skirts to be produced continuously starting from a rod which forms the inner and outer walls of the skirt. If the skirts are cut off appropriately at a step corresponding to the height of the skirt, mass production is possible. The surfaces of the skirt which bear on the soleplate, on the one hand, and on the top part of the iron, on the other hand, may be cut off by means of various cutting operations, e.g. by sawing off, slitting, plasma arc cutting, water-jet cutting and laser-beam cutting. The cutting operation can produce twisted surfaces or surfaces with a plurality of successive planes. The profile may be produced by continuous shaping, e.g. by flow turning of a sheet-steel strip. Upon exchanging the rollers, it is possible to produce profiles of different shapes. The operation is thus suitable for mass production.

The iron skirt is preferably produced from an extruded hollow profile.

Extrusion dies are cost-effective in comparison with molds or deep-drawing dies, and the process is suitable for a large number of types of plastic or metal.

The surfaces of the skirt which butt against the soleplate, on the one hand, and against the top part of the iron, on the other hand, are preferably flat.

This makes it possible to use a rectilinear and thus cost-effective profile cut. The cutting angle is selected such that the cut surfaces butting against the soleplate and the top part form the contour lines. When the cutting angle is changed, it is possible to attempt different contour lines, i.e., starting from a single profile it is possible to produce a family of different iron skirts which have the same cross section.

If small losses are accepted, it is possible to produce iron skirts of which the top and bottom cutting planes have different cutting angles.

This makes it possible to fulfill both esthetic and technical requirements.

The iron skirt preferably has inner shaped formations for connection to the respectively adjacent parts.

The profile preferably has through-passages for fastening screws or fastening core holes and shaped formations for supporting a heat shield or water container, or any other useful shaped formation.

The iron skirt is preferably made of an extruded light metal.

In this selection, it is possible to use extrusion methods known per se, and the iron skirt has all the advantages and the appearance of these materials.

The iron skirt is preferably produced from aluminum and is provided with a known decoration.

The extruded rod may be treated before the skirt elements are cut off; however, it is also possible for the cut-off skirt elements to be treated once they have been cut off; all the known advantages and possibilities of aluminum can be exploited.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIG. 1 shows a side view of an iron according to the invention;

FIG. 2 shows a plan view of the iron skirt and the outline of the iron soleplate;

DETAILED DESCRIPTION OF THE PREFERRED EMBODIMENTS

Figure 3:
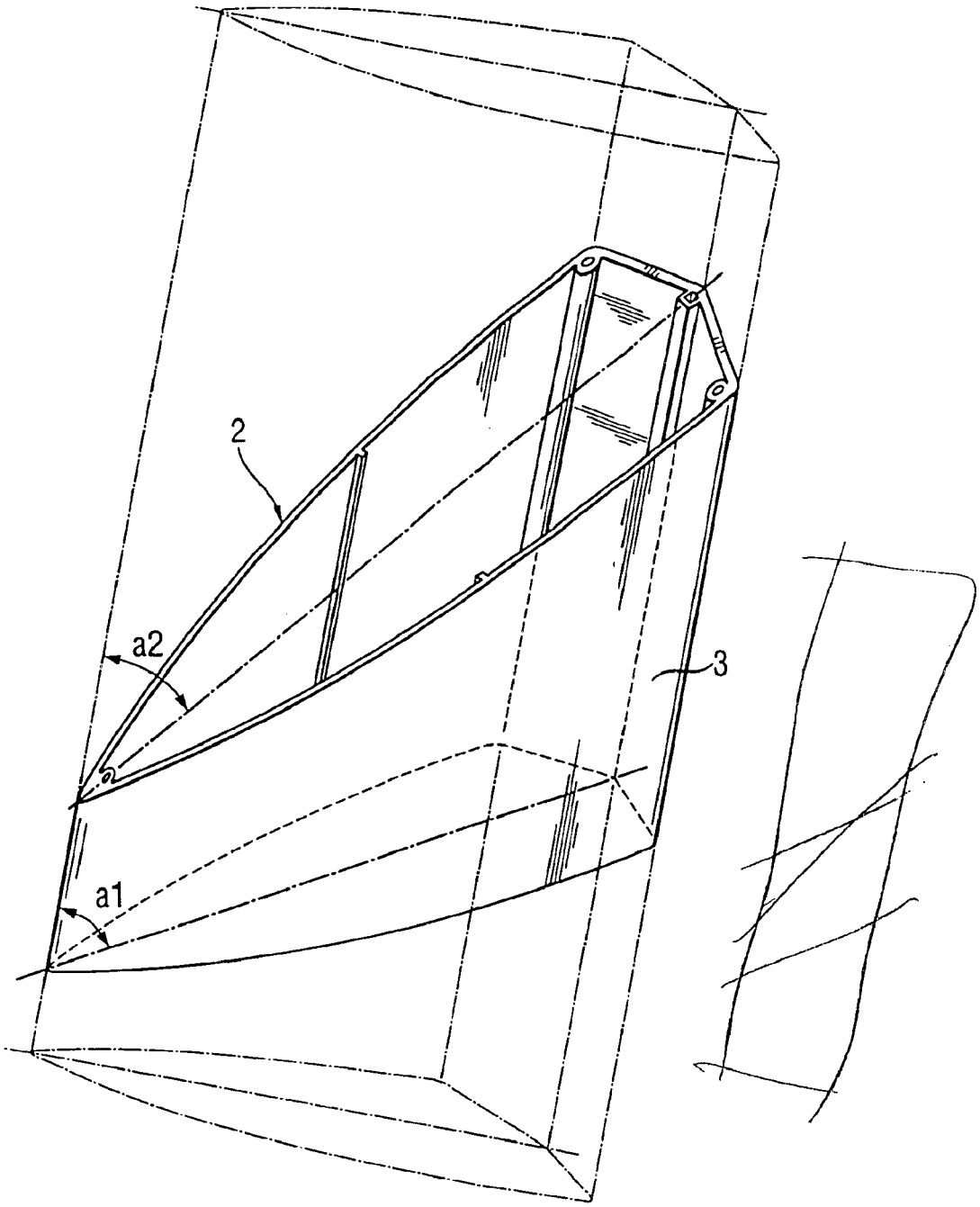
FIG. 3 shows a view of an extruded profile cut off along two different cutting planes.

According to a preferred embodiment (FIGS. 1 and 2), the skirt 2 of an iron 1 is cut off rectilinearly from a hollow profile 3 (FIG. 3) and thus comprises a blank with parallel edges 21, 22. The cutting plane is aligned perpendicularly to the plane of symmetry of the profile and forms an angle a1 with the longitudinal axis of the profile. The skirt is connected, on the one hand, to the soleplate 4, on which it is supported by means of the cut edge 21, and, on the other hand, to the iron body 5, which it bears by means of the cut edge 22. The iron body 5 and the iron soleplate 4 are screwed securely to the iron skirt 2 by means of screws, the screws passing through through-passages 23 arranged in the profile. Ribs 24 bear a heat shield which comprises a flat metal sheet and is arranged between the skirt edge 22 and the iron body 5. Protrusions of the iron body 5 and of the iron soleplate 4 engage in channel-like recesses 25 for preliminary-centering purposes.

Figure 4:
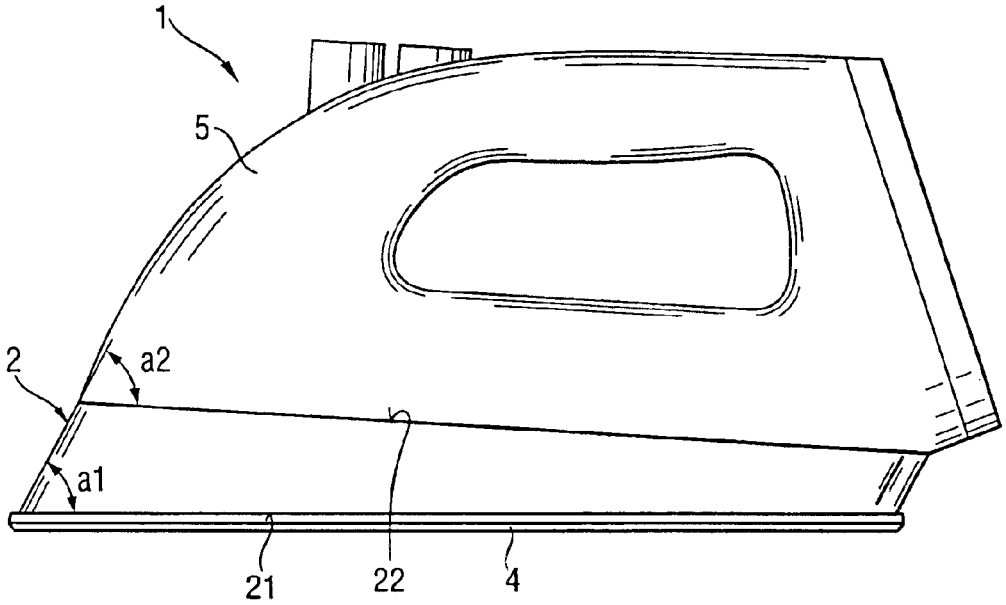
FIG. 4 shows a side view of another embodiment of an iron with a skirt according to the invention.

According to another embodiment (FIG. 4), the skirt edges 21, 22 form different angles with the axis of the profile in each case, which gives the iron a different outer form although it is possible to start from the same profile.

According to a further embodiment, the skirt edges 21, 22 are arranged in mutually parallel planes, but the angle a2 formed by the profile axis and said planes is smaller. As can be seen, in particular, from FIG. 3, the skirt 2, when cut at a smaller angle, has a lengthened outline. Starting from the same profile, it is thus possible to produce a different type of iron. The height of the iron skirt may also be changed, in order for it to be possible to produce irons with a different outer shape.

The iron skirt preferably consists of extruded aluminum, which allows the same possibilities for decoration as metal.

Starting from the same profile, according to the invention, it is thus possible to produce different designs cost-effectively and to provide product families.

The invention is not limited by the embodiments described above which are presented as examples only but can be modified in various ways within the scope of protection defined by the appended patent claims.

I claim:

1. An iron skirt comprising a blank cut off from a profile, the blank having a uniform axial section and being configured for use on an iron.

2. An iron skirt as defined in claim 1, wherein the profile is a hollow profile.

3. An iron skirt as defined in claim 1, wherein the profile is an extruded profile.

4. An iron skirt, comprising a blank cut off from a profile, wherein the profile has a uniform axial section, flat abutment surfaces including a lower abutment surface abuttable against a soleplate of an iron, and an upper abutment surface abuttable against a top part of an iron.

5. An iron skirt as defined in claim 4, wherein top and bottom cutting planes which define the blank have different cutting angles.

6. An iron skirt as defined in claim 3, wherein the profile has inner shaped formations for connection to adjacent parts.

7. An iron skirt as defined in claim 3, wherein the profile is produced from light metal.

8. An iron skirt as defined in claim 6, wherein the profile is produced from aluminum.

9. An iron skirt as defined in claim 6, wherein the profile has a decorative appearance.

10. A process for producing a skirt for an iron, comprising the steps of: extruding a profile shaped as a skirt for an iron; and cutting a blank of uniform axial section from the profile.

11. An iron comprising:

an iron body; and a skirt mounted to the iron body, the skirt being a blank of uniform axial section cut-off from a profile.

* * * * *